US007080421B1

(12) United States Patent
Delfs

(10) Patent No.: US 7,080,421 B1
(45) Date of Patent: Jul. 25, 2006

(54) BEDDING ARTICLE WITH OVERLAYING PORTIONS

(75) Inventor: Juliette M. Delfs, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 11/192,602

(22) Filed: Jul. 29, 2005

(51) Int. Cl.
*A47G 9/00* (2006.01)
*A47G 9/02* (2006.01)

(52) U.S. Cl. ..... 5/645; 5/502; 5/711

(58) Field of Classification Search ..... 5/645, 5/644, 654, 710, 711, 712, 709, 502
See application file for complete search history.

(56) References Cited

U.S. PATENT DOCUMENTS 1,206,775 A 11/1916 Everts
2,589,303 A 3/1952 Sourbeck
2,604,641 A * 7/1952 Reed ..... 5/710
2,691,179 A * 10/1954 Kann ..... 5/710
3,297,023 A * 1/1967 Foley ..... 601/148
3,298,044 A * 1/1967 Saltness et al. ..... 5/644
3,411,164 A 11/1968 Sumergrade
3,443,267 A * 5/1969 Schuckman ..... 5/645
4,389,742 A * 6/1983 DeWitt ..... 5/654
4,922,564 A * 5/1990 Thomas ..... 5/737
5,471,691 A 12/1995 Ryndak
5,557,816 A 9/1996 Pedersen et al.
5,644,810 A 7/1997 Kato
5,661,862 A 9/1997 Ryndak
5,778,470 A 7/1998 Haider
5,987,669 A 11/1999 Leggett et al.

* cited by examiner

*Primary Examiner*—Alexander Grosz
(74) *Attorney, Agent, or Firm*—Jensen & Puntigam, P.S.

(57) ABSTRACT

The bedding article includes three fabric sections having approximately the same size and positioned in registry. Two fabric baffle strips extend in one dimension between and connected to upper and middle fabric sections, defining three interior chambers therebetween. Two fabric baffle strips extend in a dimension perpendicular to the dimension between and connected to the lower and middle fabric sections, also defining three chambers therebetween. Loose filling is placed into all of the chambers defined by the baffle strips.

23 Claims, 3 Drawing Sheets

FIG.4
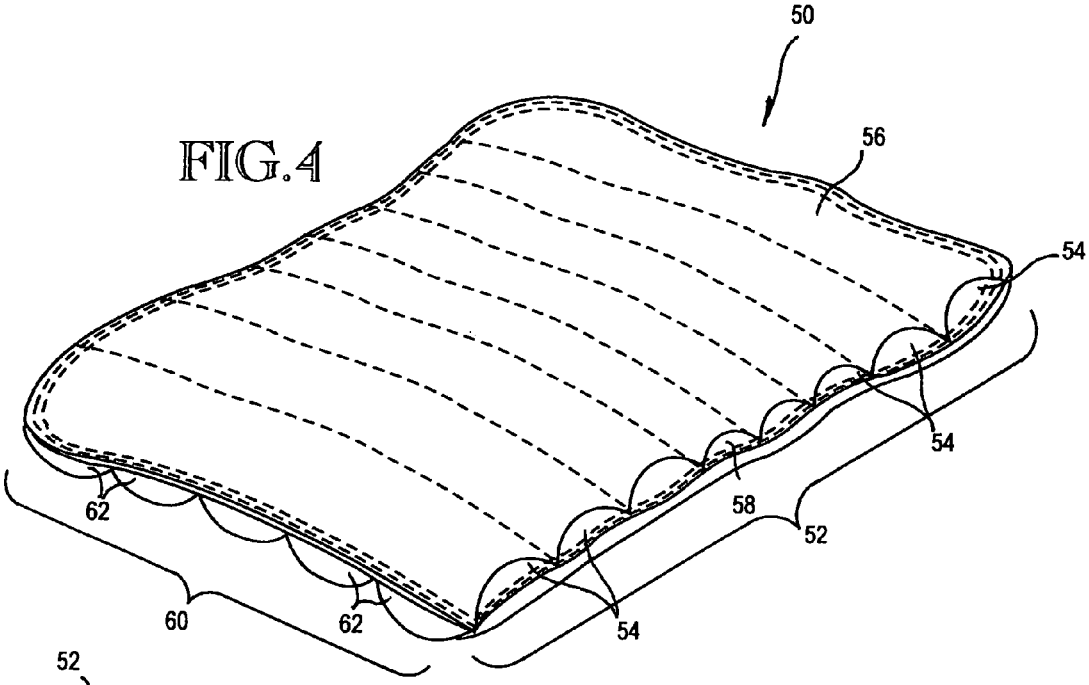
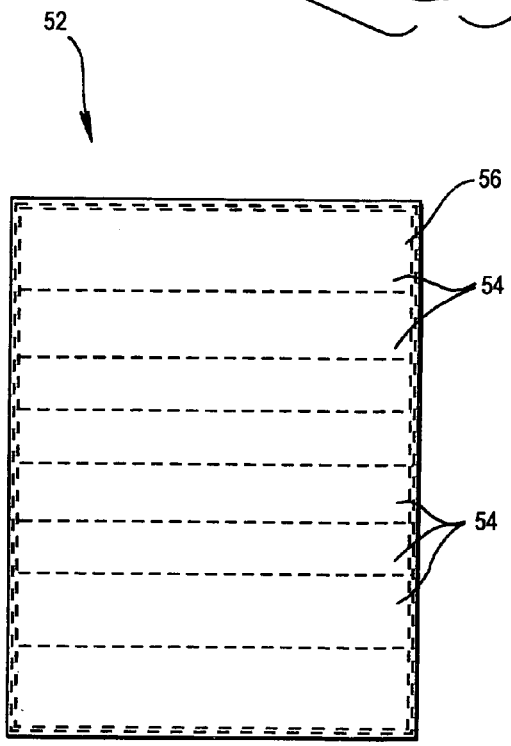
FIG.5
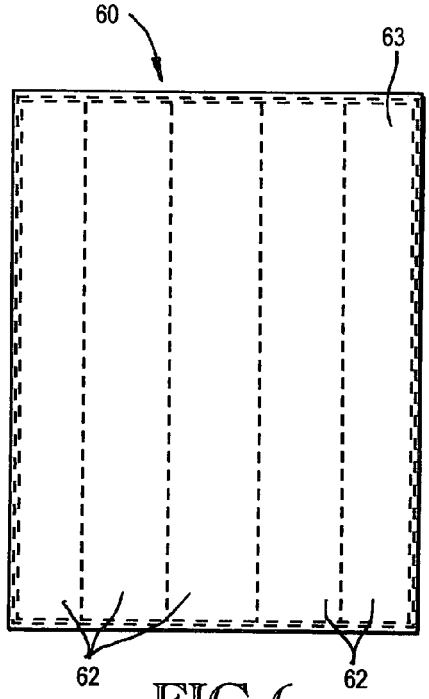
FIG.6

BEDDING ARTICLE WITH OVERLAYING PORTIONS

TECHNICAL FIELD

This invention relates generally to bedding articles, and more particularly concerns such a bedding article having upper and lower portions with chambers defined in each portion.

BACKGROUND OF THE INVENTION

Various bedding articles, such as pillows, cushions and featherbeds, as well as furniture cushions, are often filled with loose filling such as feathers, down and polyester or other man-made filling, or various combinations thereof. Such articles using loose filling are typically quite comfortable, but the filling often shifts within the article when weight is applied and/or the article is compressed. During use, particularly after extended use, the filling will shift away from the point of compression. Re-fluffing is then necessary to then achieve maximum comfort. However, during a particular period of use, such as during a single night's sleep, it is not practical to re-fluff the article.

Thus, it would be desirable to have bedding and related articles with a particular arrangement which reduces shifting of the filling during use, thereby maintaining the comfort of the article during a selected use.

SUMMARY OF THE INVENTION

Accordingly, the bedding article comprises: first, second and third fabric sections, the second fabric section being intermediate the first and third fabric sections, the fabric sections being all approximately the same size and positioned in registry; at least two spaced first fabric baffle strips which extend for substantially one entire dimension of the article, secured between the first and second fabric sections; at least two spaced second fabric baffle strips which extend for substantially another entire dimension of the article, which is approximately perpendicular to the one dimension, secured between the third and second fabric sections, the first baffles defining at least three successive interior chambers between the first and second fabric sections and the second baffles defining at least three successive interior chambers between the second and third fabric sections; and loose filling in all of the chambers.

BRIEF DESCRIPTION OF THE DRAWINGS

FIG. 4 is a perspective view of a featherbed which includes an embodiment of the construction arrangement of the present invention.

FIG. 5 is a top view of an upper portion of the featherbed of FIG. 4.

FIG. 6 is a bottom view of the lower portion of the featherbed of FIG. 4.

BEST MODE FOR CARRYING OUT THE INVENTION

Figure 1:
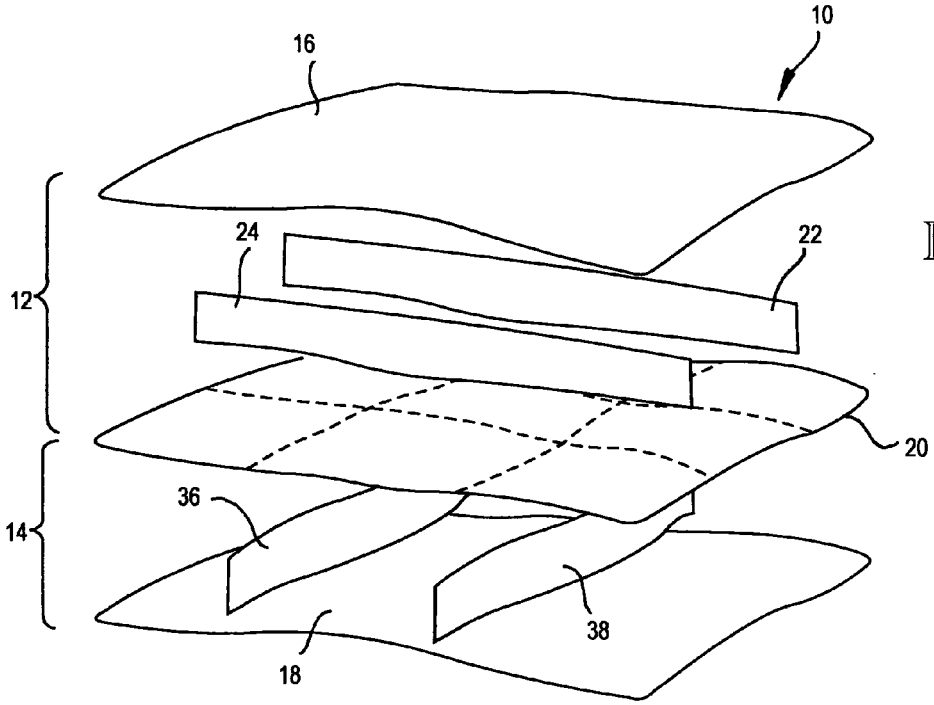
FIG. 1 is an exploded view of a pillow showing the construction of the present invention.
Figure 2:
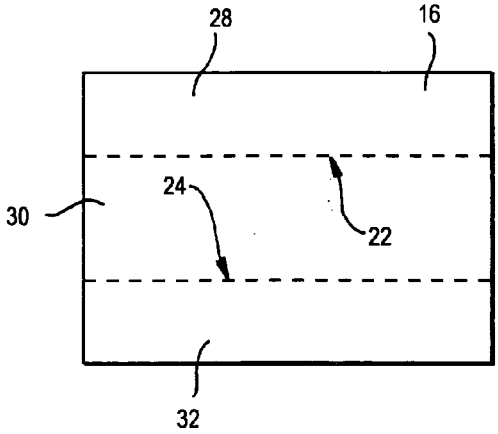
FIG. 2 is a top view of the upper layer of the pillow of FIG. 1.
Figure 3:
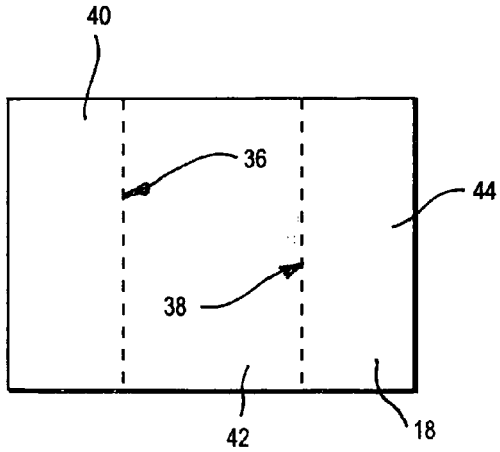
FIG. 3 is a bottom view of the lower layer of the pillow of FIG. 1.

Reference is now made to FIGS. 1, 2 and 3, which show a pillow 10 which includes the construction and arrangement of the present invention. Pillow 10 includes a top portion 12 and a bottom portion 14. The top portion includes an upper layer 16, while the bottom portion 14 includes a lower layer 18. The top and bottom portions share an intermediate layer 20. The upper, intermediate and lower layers are generally rectangular in configuration and are substantially identical. Their dimensions will differ depending upon the actual size of the pillow. The layers are made from a standard tick material, such as cotton. Other fabrics could, however, be used.

Positioned between upper layer 16 and intermediate layer 20 are two flexible fabric walls or baffles 22 and 24 which extend in the longitudinal direction of the pillow. The baffles 22, 24 are sewn to the intermediate and upper layers along their lengths and divide the volume between the upper and intermediate layers into three upper chambers 28, 30 and 32. In the embodiment shown, the outboard chambers 28 and 32 are the same width, while middle chamber 30 is somewhat wider. Middle chamber 30 could also be smaller in width than chambers 28 and 32. The chambers could also be equal in width or they could be all different widths.

Positioned between intermediate layer 20 and lower layer 18 are two spaced fabric baffles 36, 38 which extend in the lateral direction of the pillow. Baffles 36, 38 are sewn along their lengths to the intermediate and lower layers and define lower chambers 40, 42 and 44. Baffles 36 and 38 are arranged so that the two outboard chambers 40 and 44 have slightly smaller widths than middle chamber 42, although the chambers could have the same widths, or could all have different widths, or chamber 42 could be smaller than chambers 40 and 44.

While the embodiment shown has a single intermediate layer, two identical layers could be used, one for use with the upper layer and one with the lower layer. The space between them could be filled. The upper and lower layers could be single pieces of fabric, or they could be pieced, such as with multi-color panels, to illustrate the various chambers.

The configuration shown defines a total of nine sections within the pillow as a whole. The number of baffles in the top and bottom portions can be varied. For instance, there could be more than two baffles in either or both of the top and bottom portions, thereby defining more than three chambers within either or both of the top and bottom portions. The number of baffles may be different in the top and bottom portions, respectively; the larger number of baffles could be either in the top or the bottom portions. Typically, the baffle members will extend the entire distance (length or width) of the pillow. They could be somewhat shorter, however. The baffle members 22, 24 and 36, 38 can be made of cotton, polyester or other flexible fabric material.

The baffle members in the top portion could extend longitudinally as shown, or laterally. The baffle members in the bottom portions are approximately perpendicular to the baffle members in the top portion.

Figure 7:
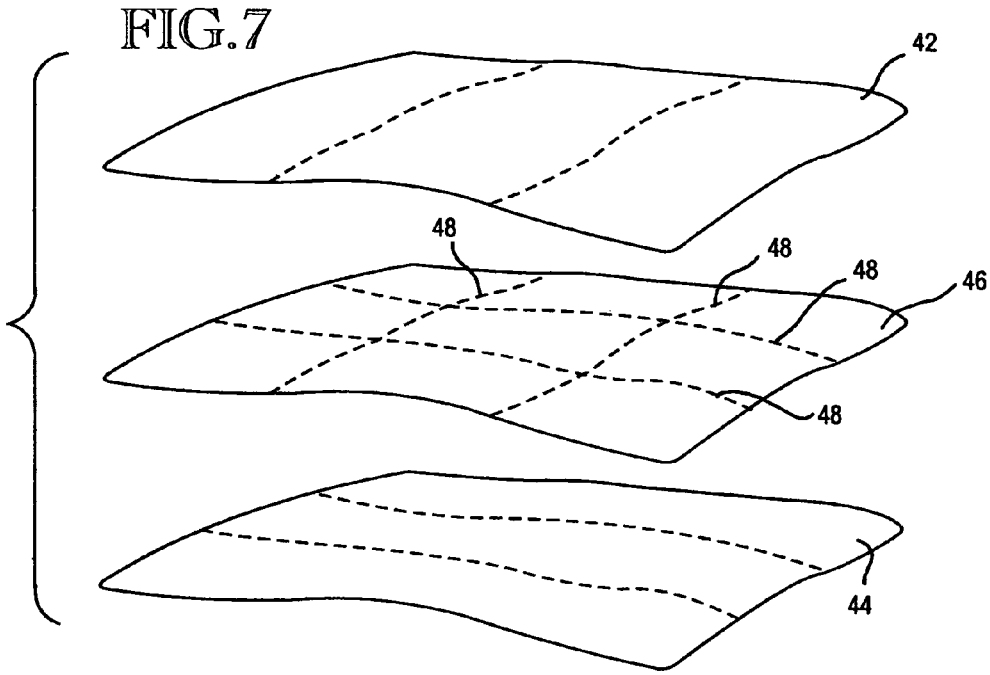
FIG. 7 is an exploded view of another embodiment of the present invention.

Alternatively, instead of baffles, the upper and lower layers could be sewn directly to the intermediate layer, i.e. lines of stitching which extend between the intermediate and upper layers along the lines of the baffles 22 and 24 and lines of stitching connecting the intermediate and lower layers along the lines of baffles 36 and 38. This embodiment is shown in FIG. 7, with upper layer 42, lower layer 44, intermediate layer 46 and several lines of stitching 48–48. In a variation, the top portion could have baffles and the bottom portion lines of stitching, or vice versa.

In the embodiment shown, the chambers extend longitudinally of the pillow and laterally of the pillow, approximately perpendicular to each other. The baffles (and hence the chambers) could be at an angle to the longitudinal/lateral directions, but still should be approximately perpendicular to each other. Filling is then placed in the three chambers in the top portion as well as the three chambers in the bottom portion. The filling can be varied, i.e. natural filling such as feathers and/or down, or manmade filling, including polyester or similar material, or combinations thereof. In the arrangement shown, the filling in each of the chambers will be approximately equal by weight. If the chambers are equal in width, the filling quantity will be varied somewhat in order to obtain the desired result of maintaining comfort and support by preventing filling shift in the pillow during use.

FIGS. 4–6 show a featherbed which incorporates a similar structure. The featherbed is shown generally at 50 and has a top portion 52, with a plurality of successive chambers 54–54 extending laterally (across the featherbed) for the entire length of the featherbed. The chambers 54–54 are formed by sewing through top layer 56 and an intermediate layer 58 of the featherbed. In the embodiment shown, there are a total of eight such chambers, although this number can be varied. The chambers become slightly narrower from the respective ends of the featherbed to the center thereof.

The bottom portion 60 includes a plurality of chambers 62–62 which extend in a longitudinal direction (along the length of the featherbed) for the approximate length of the featherbed. The bottom portion is defined by a lower layer 63 and intermediate layer 58. The chambers 62–62 are defined by lines of stitching which connect the lower layer 63 to the intermediate layer 58. In the embodiment shown, there are a total of five longitudinal chambers, although this number can be varied. The width of the longitudinal chambers can vary somewhat, or they can be all substantially equal in width.

Although the individual chambers in the top and bottom portions of the featherbed shown are formed by lines of stitching which directly connect the top layer and the bottom layer, respectively, to the intermediate layer, baffle members could be used as well, similar to that shown and described for the pillow.

Figure 8:
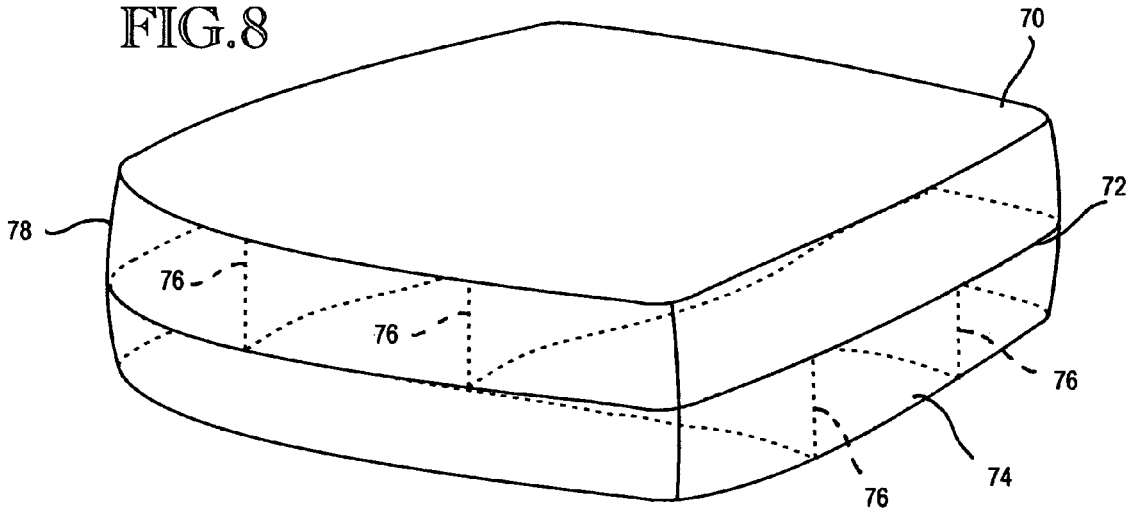
FIG. 8 is a see-through view of a furniture cushion embodying the present invention.

Other bedding articles, including cushions and fiber beds, as well as others, can be constructed using the above structural concept. As an example, a furniture cushion is shown in FIG. 8, including top, intermediate and lower layers 70, 72 and 74. Baffles 76–76 could be used to form the several chambers, or the layers could be sewn together, as described above. A side gusset 78 could be included, if desired.

The arrangement of the top and bottom portions and the chambers defined within the top and bottom portions, with the chambers in the bottom portion, extending substantially perpendicularly to the chambers in the top portion, help to prevent undesirable shifting of loose filling within a bedding article, which otherwise occurs during compression of the article during normal use.

Although a preferred embodiment of the invention has been disclosed for purposes of illustration, it should be understood that various changes, modifications and substitutions can be incorporated within the spirit of the invention which is defined by the claims as follows.

What is claimed is:

1. A bedding article, comprising:

first, second and third fabric sections, the second fabric section being intermediate the first and third fabric sections, the fabric sections being all approximately the same size and positioned in registry;

at least two spaced first fabric baffle strips which extend for substantially all of one entire dimension of the article, secured between the first and second fabric sections;

at least two spaced second fabric baffle strips which extend for substantially all of another entire dimension of the article, which is approximately perpendicular to the one dimension, secured between the third and second fabric sections, the first baffles defining at least three successive interior chambers between the first and second fabric sections and the second baffles defining at least three successive interior chambers between the second and third fabric sections; and loose filling in all of the chambers.

2. The article of claim 1, wherein the first baffle strips extend longitudinally of the article between the first and second fabric sections and wherein the second baffle strips extend laterally of the article between the second and third fabric sections.

3. The article of claim 1, wherein the interior chambers between the first and second fabric sections or the interior chamber between the third and second fabric sections are substantially equal in width.

4. The article of claim 1, wherein at least one of the first and second fabric sections is comprised of a plurality of individual pieces of fabric secured together.

5. The article of claim 1, wherein the interior chambers between the first and second fabric sections are not all equal in width and wherein the interior chambers between the third and second fabric sections are not all equal in width.

6. The article of claim 1, wherein there are a different number of chambers between the first and second fabric sections than between the third and second fabric sections.

7. The article of claim 1, wherein the bedding article is a pillow.

8. The article of claim 1, wherein the bedding article is a featherbed.

9. A bedding article, comprising:

first, second and third fabric sections, which are approximately the same size and are positioned in registry;

at least two spaced lines of attachment, extending for substantially all of the entire dimension of the article, connecting the first and second fabric sections together, defining at least three first interior chambers between the first and second fabric sections;

at least two spaced lines of attachment, extending for substantially all of another entire dimension of the article, connecting the third and second layers together, defining at least three second interior chambers between the third and second fabric sections, wherein the chambers between the third and second fabric sections extend approximately perpendicularly to the chambers between the first and second fabric sections; and loose filling located in all of the chambers.

10. The bedding article of claim 9, wherein the first chambers extend in one dimension of the bedding article in either the longitudinal or lateral dimension of the bedding article, and the second chambers extend in the other dimension.

11. The bedding article of claim 9, wherein the article is a pillow.

12. The bedding article of claim 9, wherein the article is a featherbed.

13. The bedding article of claim 9, wherein the first chambers and the second chambers, respectively, are not all of equal width.

14. A cushioned article, comprising:

first, second and third fabric sections, the second fabric section being intermediate the first and third fabric sections, the fabric sections being all approximately the same size and positioned in registry;

first means extending for substantially all of one entire dimension of the article for securing the first and second fabric sections along selected lines of attachment;

second means extending for substantially all of another entire dimension of the article, which is approximately perpendicular to the one dimension, for securing the third and second fabric sections along selected lines of attachment, the first means defining at least three successive interior chambers between the first and second fabric sections and the second means defining at least three successive interior chambers between the second and third fabric sections; and loose filling in all of the chambers.

15. The cushioned article of claim 14, wherein the cushioned article is a pillow.

16. The cushioned article of claim 14, wherein the cushioned article is a featherbed.

17. The cushioned article of claim 14, wherein the cushioned article is a furniture cushion.

18. The cushioned article of claim 14, wherein the first and second means are fabric baffle strips.

19. The cushioned article of claim 14, wherein the first and second means are lines of attachment.

20. The cushioned article of claim 14, wherein one of the first and second means are fabric baffle strips and wherein the other of the first and second means are lines of attachment.

21. A bedding article, comprising:

first, second and third fabric sections, the second fabric section being intermediate the first and third fabric sections, wherein one or more of the fabric sections comprises one or more fabric pieces, the fabric sections being all approximately the same size and positioned in registry;

first means extending for substantially all of one entire dimension of the article for securing the first and second fabric sections along selected lines of attachment;

second means extending for substantially all of another entire dimension of the article, which is approximately perpendicular to the one dimension, for securing the third and the second fabric sections along selected lines of attachment, the first means defining at least three successive interior chambers between the first and second fabric sections and the second means defining at least three successive interior chambers between the second and third fabric sections; and loose filling in all of the chambers.

22. A bedding article of claim 21, wherein the second fabric section includes two fabric pieces, wherein the first means secures the first fabric section and one fabric piece together, wherein the second means secures the third fabric section and another fabric piece together, defining an interior volume between the one and another fabric pieces.

23. A bedding article of claim 22, wherein the article is a pillow.

* * * * *